US006515645B1

(12) United States Patent
Yano et al.

(10) Patent No.: US 6,515,645 B1
(45) Date of Patent: Feb. 4, 2003

(54) LIQUID CRYSTAL DISPLAY APPARATUS

(75) Inventors: Takakazu Yano, Tokyo (JP); Shigeru Morokawa, Higashiyamato (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/336,676

(22) Filed: Jun. 21, 1999

(30) Foreign Application Priority Data

Jun. 22, 1998 (JP) ..... 10-174379

(51) Int. Cl.[7] ..... G09G 3/36
(52) U.S. Cl. ..... 345/89; 345/205
(58) Field of Search ..... 345/87, 90, 206, 345/147, 94, 95, 103, 50, 54, 89; 349/54, 143, 146, 149–152, 158

(56) References Cited

U.S. PATENT DOCUMENTS 3,655,269 A * 4/1972 Heilmeiler ..... 349/177
3,738,099 A * 6/1973 Tanaka ..... 368/30
4,255,804 A * 3/1981 Suganuma ..... 368/84
4,764,766 A * 8/1988 Aoyama et al. ..... 345/103
5,122,791 A * 6/1992 Gibbons et al. ..... 345/102
6,160,594 A * 12/2000 Hanani et al. ..... 349/34

FOREIGN PATENT DOCUMENTS

JP 06034952 A 2/1994
JP 08054639 A 2/1996

* cited by examiner

*Primary Examiner*—Richard Hjerpe
*Assistant Examiner*—Alexander Eisen
(74) *Attorney, Agent, or Firm*—Finnegan, Henderson, Farabow, Garrett & Dunner, L.L.P.

(57) ABSTRACT

A liquid crystal display apparatus includes a scan substrate, a data substrate, an animation display area formed by liquid crystal provided between the scan substrate and the data substrate, and a picture-character display area. The animation display area is driven and displayed with time-sharing in accordance with scan signals which are applied to scan electrodes formed on the scan substrate and output from the scan circuit, and data signals which are applied to data electrodes formed on the data substrate and output from the data circuit. The picture-character area is driven and displayed in accordance with data signals which are applied to data picture-character electrodes formed on the data substrate and output from the data circuit, and data signals which are applied to scan picture-character electrodes formed on the scan substrate and output from the data circuit.

9 Claims, 10 Drawing Sheets

901
902
903
907
904
905(902)
906
907

LIQUID CRYSTAL DISPLAY APPARATUS

BACKGROUND OF THE INVENTION

1. Field of the Invention

The present invention relates to a liquid crystal display apparatus including a display area which is formed as an animation display area and a picture-character display area.

2. Description of the Related Art

Recently, there are various kinds of portable electronic equipment, such as an electronic notebook and a portable phone, in which a liquid crystal is used as a display apparatus. In the display apparatus, one or more picture characters indicating, for example, use state of a battery, alarm of clock, etc., are always displayed on the picture-character display area. Particularly, these picture-characters are always watched and are indispensable in an actual use of the liquid crystal display apparatus.

On the other hand, there is a liquid crystal display apparatus in which the animation display area and the picture-character display area are arranged on the same one display area in order to realize low cost and to reduce the size of the liquid crystal display apparatus.

For example, in Japanese Unexamined Patent Publication No. 6-34952 (JPP-6-34952), a common driver and a data driver, which are particularly used for displaying picture-characters, are provided for driving only the picture-characters separately from the animation display area.

Further, in Japanese Unexamined Patent Publication No. 8-54639 (JPP-8-54639), a data driver for animation and another data driver for picture-characters are arranged on the same direction based on improved wiring patterns of electrodes in order to realize a saving of space.

There is a problem, however, in the above conventional arts in which a segment drive circuit and common drive circuit, which are particularly used for the picture-character, are always provided for the picture-character so that a size of the apparatus and production cost thereof are increased.

SUMMARY OF THE INVENTION

The object of the present invention is to provide a liquid crystal display apparatus which can realize low cost and space saving by utilizing a part of the output terminals of the data driver in order to display the picture-characters.

In accordance with the present invention, there is a liquid crystal display apparatus including a scan substrate for mounting a scan circuit, a data substrate for mounting a data circuit, an animation display area formed by liquid crystal provided between the scan substrate and the data substrate for displaying an animation, and a picture-character display area formed by the liquid crystal for displaying picture-characters, characterized in that;

- the animation display area is driven and displayed with time-sharing in accordance with scan signals which are applied to scan electrodes formed on the scan substrate and output from the scan circuit, and data signals which are applied to data electrodes formed on the data substrate and output from the data circuit; and
- the picture-character area is driven and displayed in accordance with data signals which are applied to data picture-character electrodes formed on the data substrate and output from the data circuit, and data signals which are applied to scan picture-character electrodes formed on the scan substrate and output from the data circuit.

In a preferred embodiment, the data signals which are applied to the data picture-character electrodes and output from the data circuit, are changed to a predetermined waveform so that the picture-characters are displayed with half-tones.

In another preferred embodiment, the data signals which are applied to the scan picture-character electrodes and output from the data circuit, are changed to predetermined a waveform so that the picture-characters are displayed with half-tones.

In still another preferred embodiment, a predetermined resistance is formed on the data picture-character electrode so that the picture-characters are displayed with half-tones.

In still another preferred embodiment, a predetermined resistance is formed on the scan picture-character electrode so that the picture-characters are displayed with half-tones.

In still another preferred embodiment, opposite electrodes for deriving data signals, which are applied to the scan picture-character electrodes and output from the data circuit, to the scan circuit, are formed on the data substrate; and electrodes for scan signals which are input to the scan circuit, electrodes for data signals which are input to the data circuit, and electrodes for input signals which are input to the scan circuit, are provided on an one-faced wiring flexible printed-circuit (FPC) board.

In the present invention, as explained in detail below, an output of the data driver is connected to a picture-character opposite electrode which is an opposite electrode of the picture-character area on the opposite substrate, by using, for example, a flexible printed-circuit (FPC) board. Further, the output of the data driver is connected to the picture-character electrode.

When a phase of the waveform between the picture-character electrode and the picture-character opposite electrode is different from each other, the picture-characters are displayed. On the other hand, when the phases of the waveforms of the picture-character electrode and the picture-character opposite electrode are the same, the picture-characters are not displayed. In this case, the picture-characters are displayed statically and independently from a display of the animation.

DESCRIPTION OF THE PREFERRED EMBODIMENTS

Figure 1:
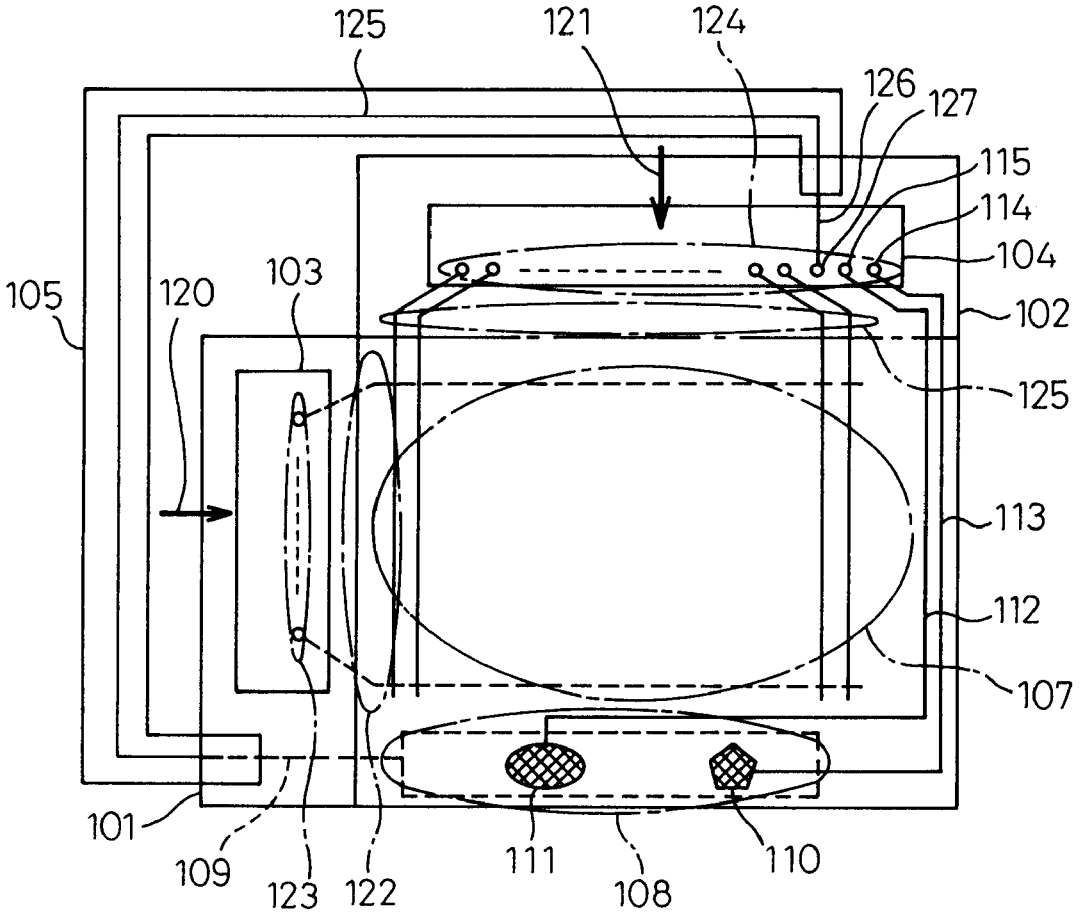
FIG. 1 shows a simple matrix type liquid crystal display apparatus according to a first embodiment of the present invention.

FIG. 1 shows a simple matrix type liquid crystal display apparatus according to the first embodiment of the present invention. In FIG. 1, a row-side IC substrate 101 is made of a glass plate, and includes a common driver 103 which is driven by an external signal 120 (see an arrow line). The common driver 103 includes a scan output terminal group 123 which is formed by a plurality of scan output terminals. Further, the row-side IC substrate 101 includes a scan electrode group 122 which is formed by a plurality of scan electrodes and connected to the scan output terminal group 123 on the common driver 103.

Further, a column-side IC substrate 102 is also made by the glass plate, and includes a data driver 104 which is driven by the external signal 121 (see the arrow line). The data driver 104 includes a data output terminal group 124 which is formed by a plurality of data output terminals. Further, the column-side IC substrate 102 includes a data electrode group 125 which is formed by a plurality of data electrodes and connected to the data output terminal group 124 on the data driver 104.

In the above structure, a liquid crystal panel is formed by the row-side IC substrate 101, the column-side IC substrate 102 and a liquid crystal inserted therebetween.

An upper electrode for picture-character A 111 includes a transparent electrode pattern which has an oval-shaped pattern and is formed under the column-side IC substrate 102. Further, the upper electrode for picture-character A 111 is connected to a picture-character terminal A 115, which is one of data output terminals, through a pattern electrode A 112. On the other hand, an upper electrode for picture-character B 110 includes a transparent electrode pattern which has a pentagon-shaped pattern and is formed under the column-side IC substrate 102. Further, the upper electrode for picture-character B 110 is connected to a picture-character terminal B 114, which is one of data output terminals, through a pattern electrode B 113.

A lower electrode for picture-character 109 is a transparent electrode which is formed on the row-side IC substrate 101, and provided for determining a potential of an opposite substrate of the picture-character. Further, the lower electrode for picture-character 109 is connected to an opposite electrode terminal 127, which is one of data output terminals, through a lower electrode pattern for picture-character 125 on an FPC (Flexible Printed-Circuit) board 105 and an opposite pattern electrode 126 formed on the column-side IC substrate 102.

Further, the above structure can be divided into an animation area 107 and a picture-character area 108 (both shown by oval areas). The animation area 107 is provided for driving and displaying with time-sharing the liquid crystal between a scan electrode group 122 and a data electrode group 125. The picture-character area 108 is provided for driving and displaying statically the liquid crystal between the lower electrode for picture-character 109, the upper electrode for picture-character A 111 and the upper electrode for picture-character B 110.

Figure 2:
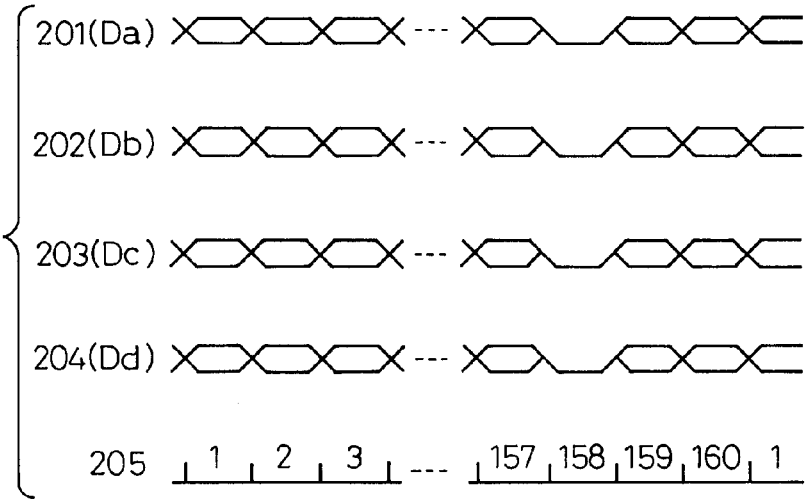
FIG. 2 shows input data for driving the data driver.

FIG. 2 shows input data for driving the data driver 104. In FIG. 2, each of data Da (201), data Db (202), data Dc (203) and data Dd (204) is binary input signal having four bits and indicating gradation of each column. The data Da (201) corresponds to a least significant bit (LSB), the data Db (202) corresponds to a second bit from the LSB, the data Dc (203) corresponds to a third bit from the LSB, and the data Dd (204) corresponds to a most significant bit (MSB).

In a terminal number 205, each numeral 1, 2 . . . , 160 at each signal indicates the terminal number from the left of output terminals in the data output terminal group 124 in FIG. 1. In this embodiment, the data output terminal group 124 includes 160 terminals.

For example, in the terminal No. 2, when all data Da to Dd are set to a high level, the display of the second column at a predetermined row becomes black. On the other hand, when all data Da to Dd are set to a low level, the display of the second column at the predetermined row becomes white. Further, when the data Da and data Dc are set to the high level, and when the data Db and the data Dd are set to the low level, the display of the second column at the predetermined row becomes gray, and this is a half tone obtained by the following calculation, i.e., $$(1+4)/(1+2+4+8)=5/15=1/3$$

The output terminals of Nos. 1 to 157 are used for driving the animation area 107. The output terminal of No. 158 corresponds to the opposite output terminal 127 and is used for determining the potential of the lower electrode for picture-character 109 which is always set to the low level in this embodiment.

The output terminal of No. 159 corresponds to the picture-character terminal A 115 which is used for the upper electrode for picture-character A 111 through the pattern electrode A 112. Further, the output terminal of No. 160 corresponds to the picture-character terminal B 114 which is used for the upper electrode for picture-character B 110 through the pattern electrode B 113.

In the output terminal of No. 159, when all data Da, Db, Dc and Dd are set to the high level, the display becomes black at the upper electrode for picture-character A 111. On the other hand, when all data Da, Db, Dc and Dd are set to the low level, the display becomes white at the upper electrode for picture-character A 111. Similarly, the upper electrode for picture-character B 110 can be driven at the output terminal of No. 160. That is, the display on the picture-character area 108 can be driven by the same data Da to Dd which are used for displaying the animation area 107.

Figure 3:
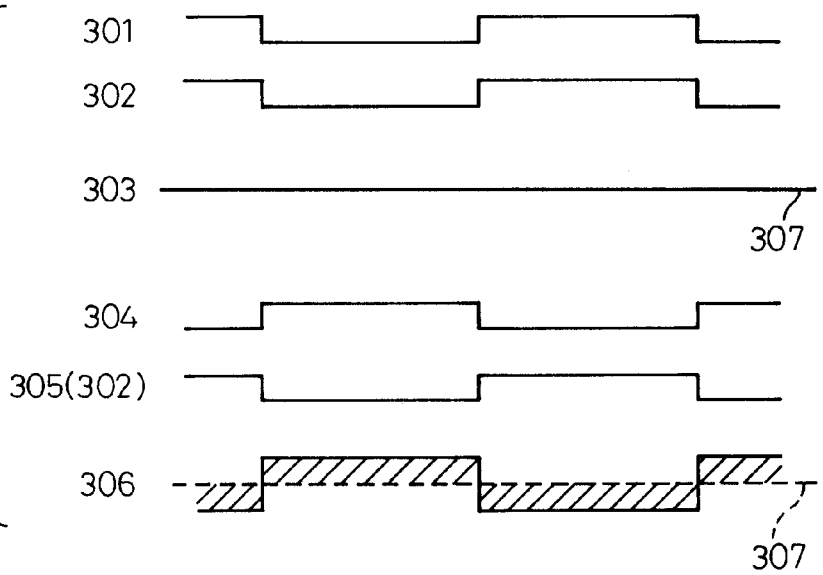
FIG. 3 shows various waveform of picture-characters at a picture-character area.

FIG. 3 shows various waveform at the picture-character area 108. In this case, the data driver 104 is driven by 3 (v), and this is applied to the picture-character area 108. In FIG. 3, numeral 301 denotes an upper drive waveform applied to the upper electrode for picture-character A 111, 302 denotes a lower drive waveform applied to the lower electrode for picture-character 109, 303 is a difference potential between the waveform 301 and 302, 304 denotes an upper drive waveform applied to the upper electrode for picture-character B 110, 305 denotes a lower drive waveform applied to the lower electrode for picture-character 109, and 306 is the difference potential between the waveform 304 and 305. Further, 307 denotes the potential of the lower side.

In this case, the upper waveform 301 is the drive waveform when the upper electrode for picture-character A 111 is set to the white level. The lower waveform 302 is the drive waveform at the lower electrode for picture character 109. The difference potential 303 indicates a potential difference observed from the lower electrode for picture-character 109. In this case, the potential difference becomes 0 (v), and the display becomes white since no potential is provided therebetween.

Further, the upper drive waveform 304 is the drive waveform when the upper electrode for picture-character B 110 is set to the white level. The lower drive waveform 305 (302) is the drive waveform at the lower electrode for picture character 109. The difference potential 306 indicates the potential difference observed from the lower electrode for picture-character 109. In this case, the waveform becomes a rectangular waveform having the potential difference of ±3 (v). That is, since an effective voltage of either ±3 (v) or −3 (v), indicated by slant lines, is applied to the liquid crystal, the display becomes black.

Figure 4:
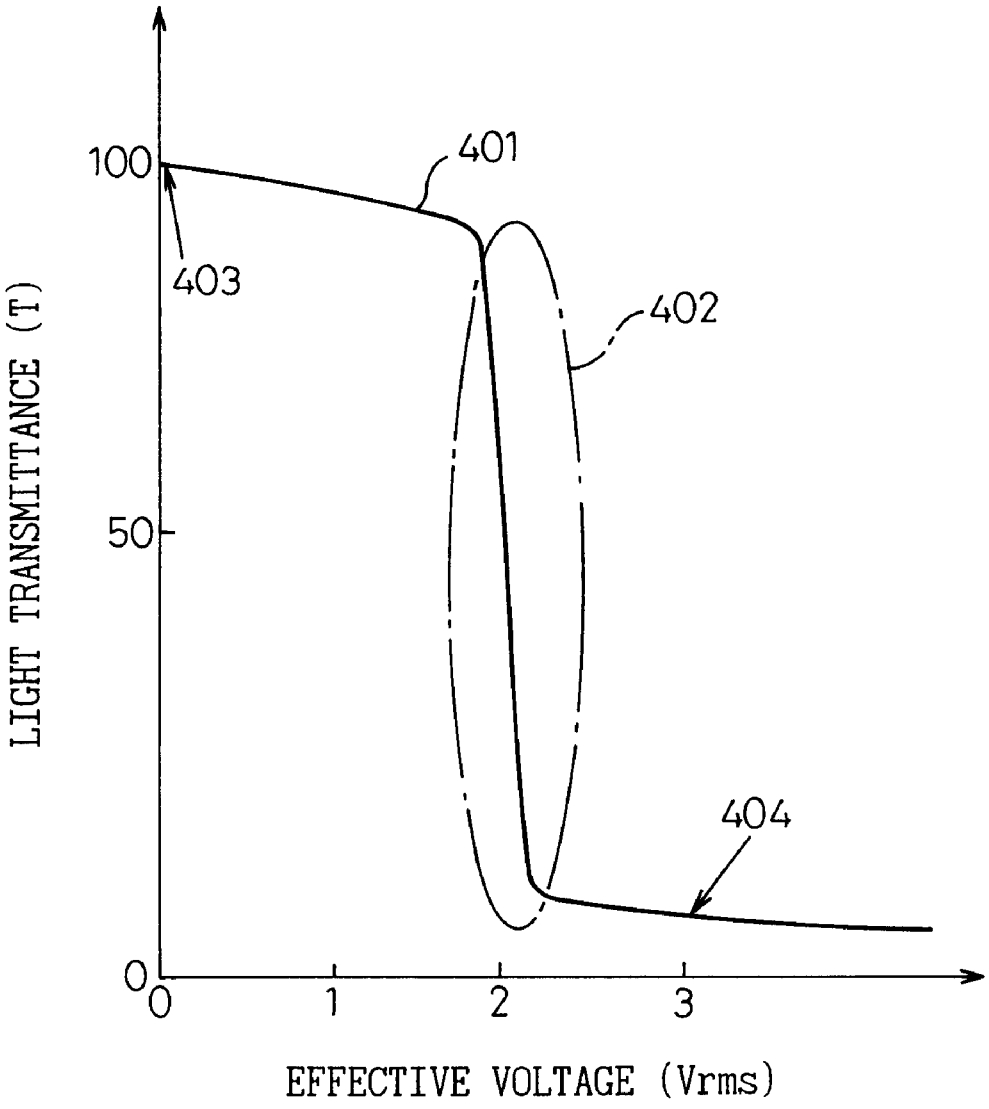
FIG. 4 shows a curve for explaining a relationship between an effective voltage (Vrms) and a light transmittance (T)

FIG. 4 shows a curve for explaining the relationship between an effective voltage (Vrms) and a light transmittance (T). This curve itself has been known as an explanation of dependency between the light transmittance and the effective voltage. In FIG. 4, 401 denotes a characteristic curve which is called "T-V curve", 402 denotes a drive extent for driving the animation area, 403 denotes a point for picture-character A, and 404 denotes the point for picture-character B. As is obvious from the curve, when no effective voltage is applied to the liquid crystal, the light is easily transmitted. On the other hand, when the effective voltage is applied to the liquid crystal, the light is not transmitted.

The drive extent 402 indicates an operational extent in order to display the image at the animation area 107 (see, FIG. 1). Usually, the light to be transmitted is controlled within the extent which is determined by a margin based on divided numbers of the area, so that the image can be displayed with gradation on the animation area 107.

The point 403 for picture-character A is the point for displaying the white picture-character, and driven by the upper drive waveform 301, the lower drive waveform 302 and the difference potential 303, shown in FIG. 3. On the other hand, the point 404 for picture-character B is the point for displaying the black picture-character, and driven by the upper driving waveform 304, the lower driving waveform 305 and the difference potential 306, shown in FIG. 3.

That is, the picture-character A in the picture-character area 108 becomes white, and the picture character B in the picture-character area 108 becomes black. In this case, the white and black colors are clearly indicated compared to those of the animation area 107. Further, in this embodiment, the FPC 105 was used to connect the opposite output terminal 127 to the lower electrode for picture character 109. However, it is possible to utilize a silver paste or an ACF (Anisotropic Conductive Film) instead of the FPC in order to connect the opposite output terminal 127 to the lower electrode for picture character 109.

Figure 5:
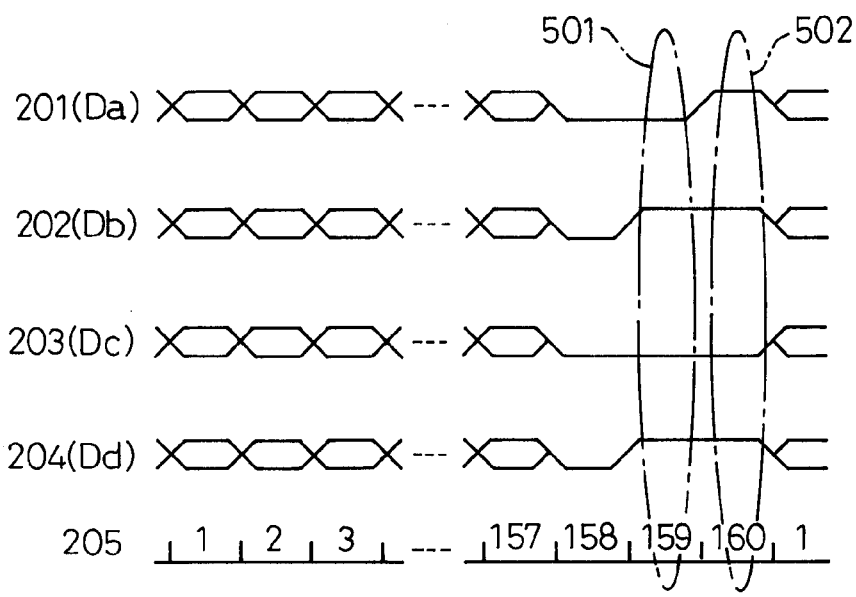
FIG. 5 shows another input data for driving the data driver according to a second embodiment of the present invention.

FIG. 5 shows another input data for driving the data driver 104 according to a second embodiment of the present invention. The data Da (201) to Dd (204) and the terminal number 205 are the same as those of FIG. 2. As shown in the drawing, in a gradation data group A 501 (see an oval area), the data Db and Dd are set to the high level, and the data Da and Dc are set to the low level. Accordingly, an output signal having a pulse width obtained by the following calculation, i.e., $$(2+8)/(1+2+4+8)=10/15=2/3$$

is output from the picture-character terminal A 115.

On the other hand, in a gradation data group B 501 (see the oval area), the data Da, Db and Dd are set to the high level, and the data Dc is set to the low level. Accordingly, an output signal having the pulse width obtained by the following calculation, i.e., $$(1+2+8)/(1+2+4+8)=11/15$$

is output from the picture-character terminal B 114.

Figure 6:
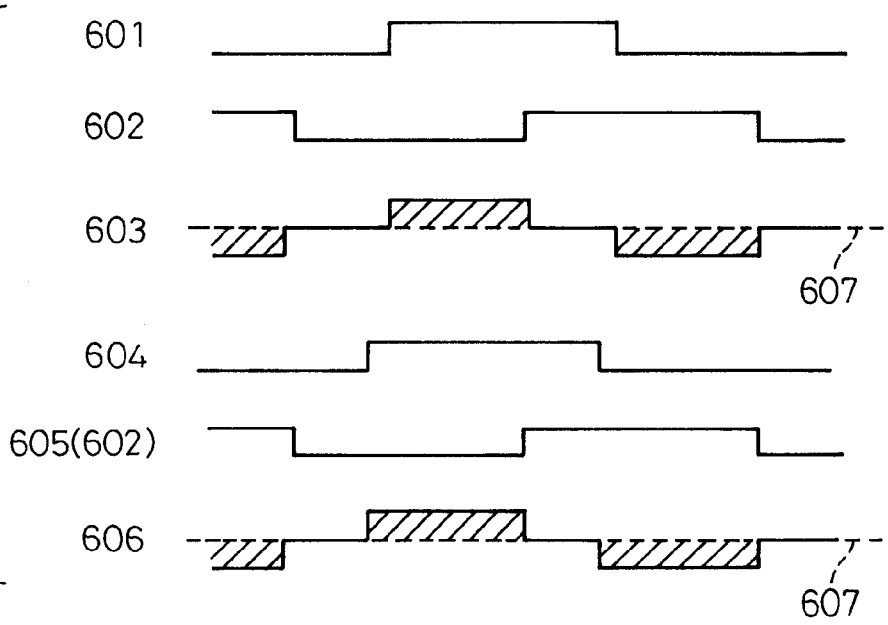
FIG. 6 shows another various waveform of picture-characters at the picture-character area.

FIG. 6 shows other various waveforms of picture-characters at the picture-character area 108. In this case, the data driver 104 is driven by 3 (v), and this voltage is applied to the picture-character area 108. In FIG. 6, numeral 601 denotes an upper drive waveform applied to the upper electrode for picture-character A 111, 602 denotes a lower drive waveform applied to the lower electrode for picture-character 109, 603 is a difference potential between the waveform 601 and 602, 604 denotes an upper drive waveform applied to the upper electrode for picture character B 110, 605 (602) denotes a lower drive waveform applied to the lower electrode for picture character 109, and 606 is the difference potential between the waveform 604 and 605. Further, 607 denotes the potential of the lower side.

In this case, the upper waveform 601 is the drive waveform at the upper electrode for picture-character A 111. The lower waveform 602 is the drive waveform at the lower electrode for picture-character 109. The difference potential 603 indicates a potential difference observed from the lower electrode for picture-character 109. In this case, an effective value which corresponds to an area shown by slant lines is valid for the liquid crystal.

On the other hand, the upper waveform 604 is the drive waveform when the upper electrode for picture-character B 110 is set to the white level. The lower waveform 605 (602) is the drive waveform at the lower electrode for picture-character 109. The difference potential 606 indicates a potential difference observed from the lower electrode for picture-character 109. In this case, an effective value which corresponds to an area shown by slant lines is valid for the liquid crystal.

Figure 7:
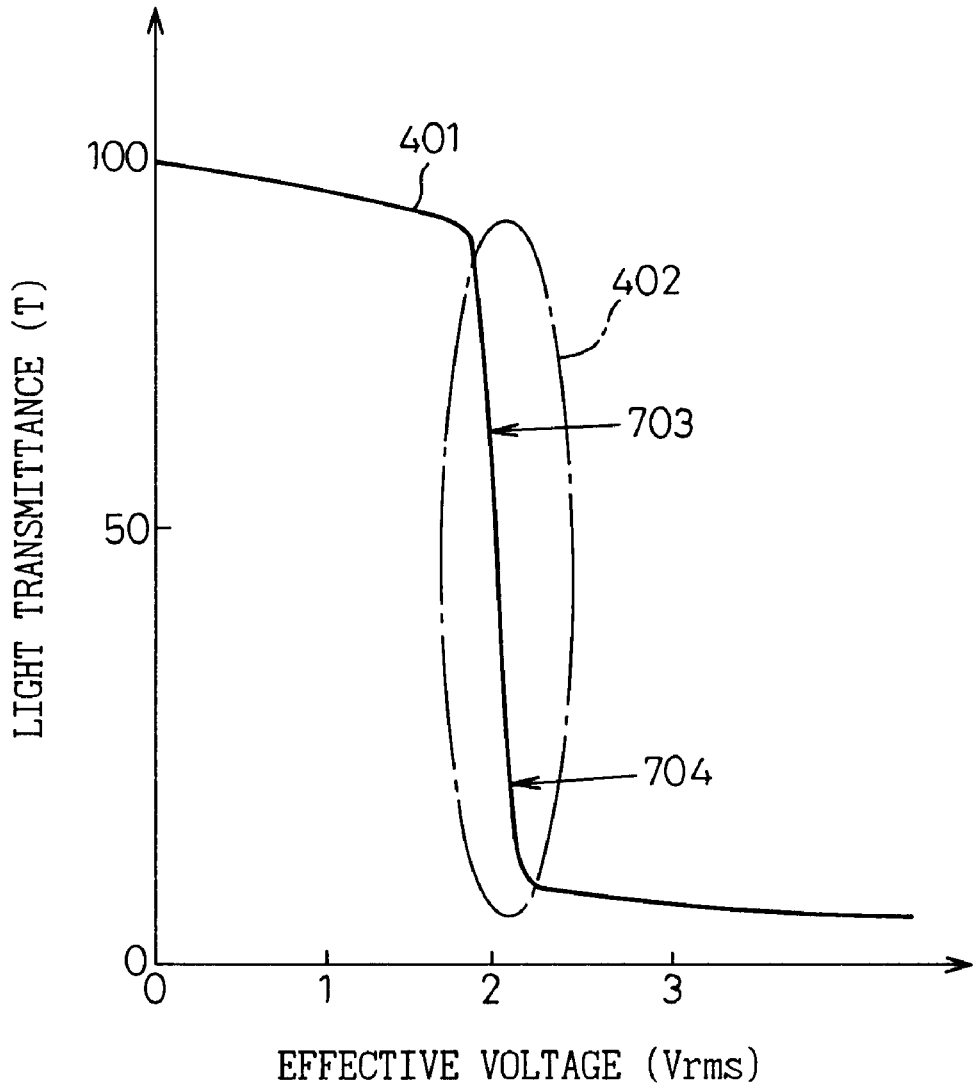
FIG. 7 shows another curve for explaining the relationship between the effective voltage (Vrms) and the light transmittance (T)

FIG. 7 shows another curve for explaining the relationship between the effective voltage (Vrms) and the light transmittance (T). The "T-V curve" 401 and the drive extent 402 of the animation area are the same as those of FIG. 4. In this embodiment, 703 denotes a point for picture character A. The point 703 is provided for displaying the picture-character with half tone in the vicinity of the location of 10/15 when the effective voltage 3 (Vrms) is given by 15/15. This point is driven by the difference potential 603 between the upper drive waveform 601 and the lower drive waveform 602 shown in FIG. 6.

On the other hand, 704 denotes the point for picture-character B. The point 704 is provided for displaying the picture-character with half tone in the vicinity of the location of 11/15 when the effective voltage 3 (Vrms) is given by 15/15. This point is driven by the difference potential 606 between the upper drive waveform 604 and the lower drive waveform 605 shown in FIG. 6.

That is, as display density on the liquid crystal, it is possible to display the image with half tone having different density at the upper electrode for picture-character A 111 and the upper electrode for picture-character B 110 in the picture-character area 108 in accordance with change of the data signal.

In the above embodiment, the output at the picture-character terminal A 115 and the picture-character terminal B 114 in FIG. 1 was explained. Further, the same means can be applied to the output of the opposite electrode terminal 127. Still further, it is possible to display the image with half tone based on a gradational display (FRC) employing a method of changing data for each frame.

Figure 8:
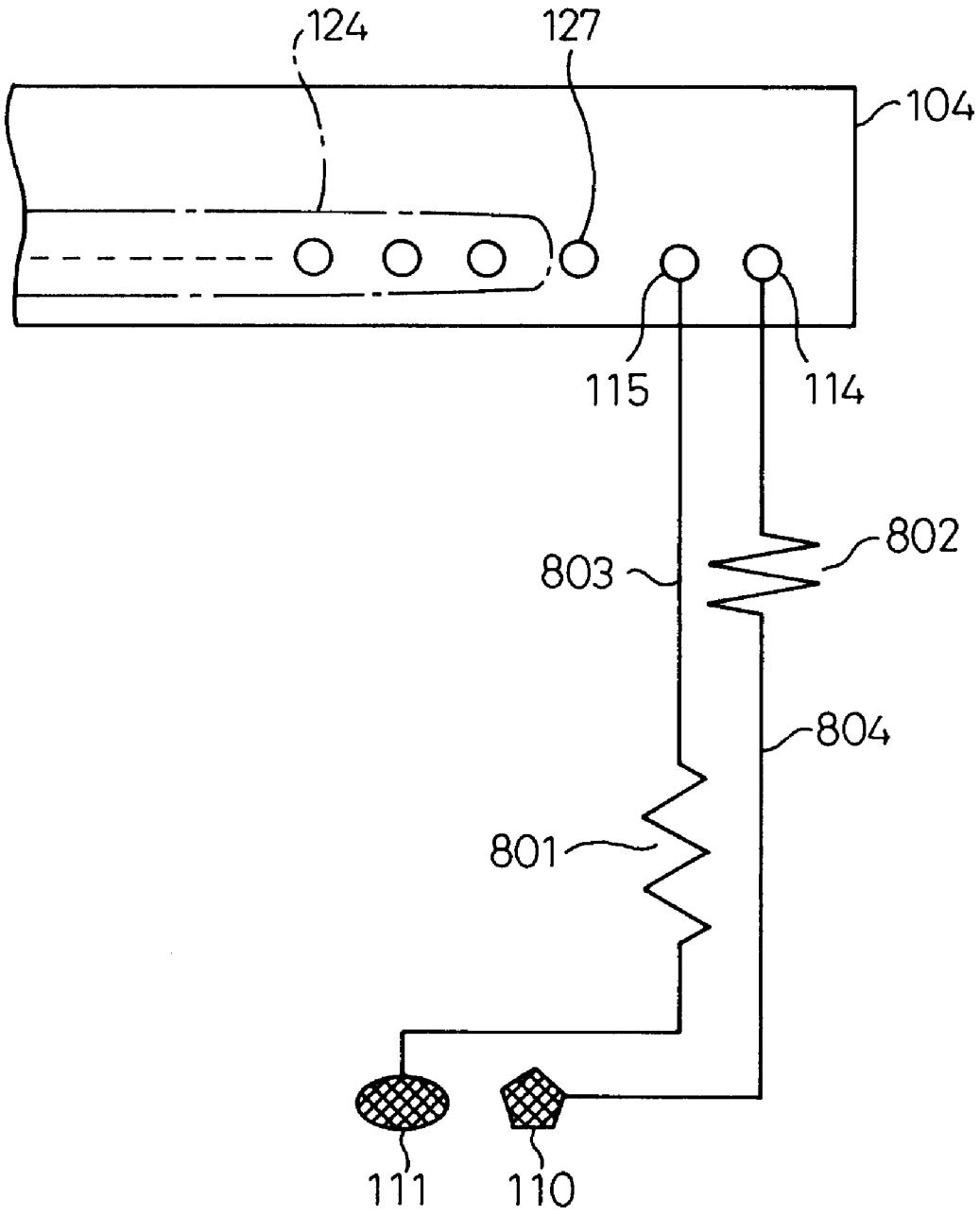
FIG. 8 shows a partially enlarged view of the data driver in FIG. 1 according to a third embodiment of the present invention.

FIG. 8 shows a partially enlarged view of the data driver 104 in FIG. 1 according to a third embodiment of the present invention. In FIG. 8, the same reference numbers used in FIG. 1 are attached to the same components in this drawing.

A pattern electrode A 803 includes a pattern resistance A 801 and is formed by a transparent electrode connecting between the picture character terminal A 115 and the upper electrode for picture-character A 111. On the other hand, a pattern electrode B 804 includes a pattern resistance B 802 and is formed by the transparent electrode connecting between the picture character terminal B 114 and the upper electrode for picture-character B 110. In this case, the resistance value of the pattern resistance A 801 is larger than that of the pattern resistance B 802.

Figure 9:
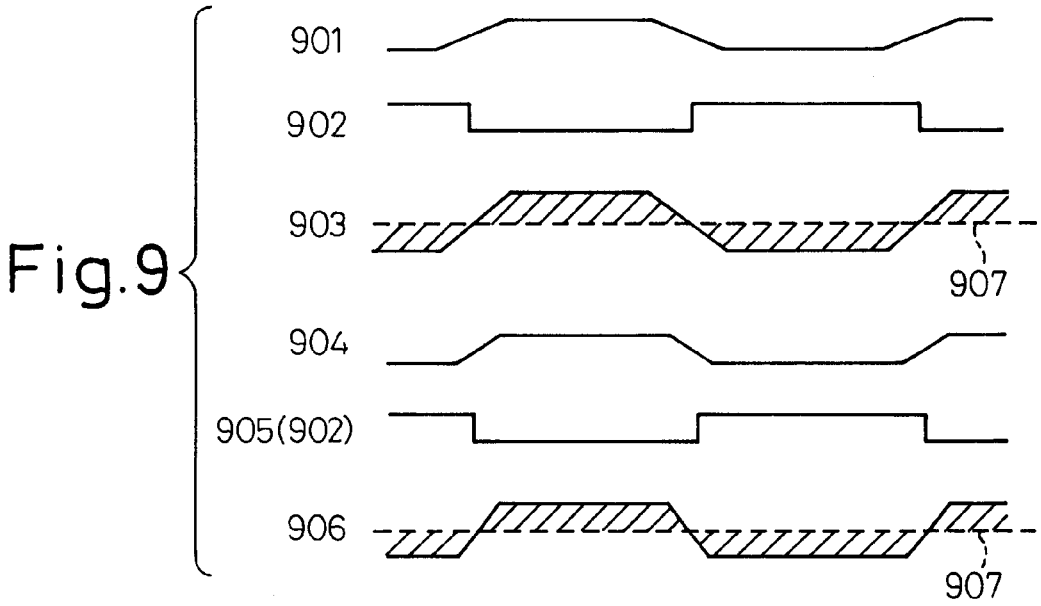
FIG. 9 shows still another various waveform of picture-characters at the picture-character area.

FIG. 9 shows still another various waveform at the picture-character area 108. In this case, the data driver 104 is driven by 3 (v), and this voltage is applied to the picture-character area 108. In FIG. 9, numeral 901 denotes an upper drive waveform applied to the upper electrode for picture-character A 111, 902 denotes a lower drive waveform applied to the lower electrode for picture-character 109, 903 is a difference potential between the waveform 901 and 902, 904 denotes an upper drive waveform applied to the upper electrode for picture-character B 110, 905 (902) denotes a lower drive waveform applied to the lower electrode for picture character 109, and 906 is the difference potential between the waveform 904 and 905. Further, 907 denotes the potential of the lower side.

In this case, the upper drive waveform 901 is delayed due to the pattern resistance A 801 of the upper electrode for picture-character A 111. The lower waveform 902 is the drive waveform at the lower electrode for picture-character 109. The difference potential 903 indicates a potential difference observed from the lower electrode for picture-character 109. In this case, an effective value, which corresponds to an area shown by slant lines (a delayed portion of the area is reduced), is valid for the liquid crystal.

Figure 10:
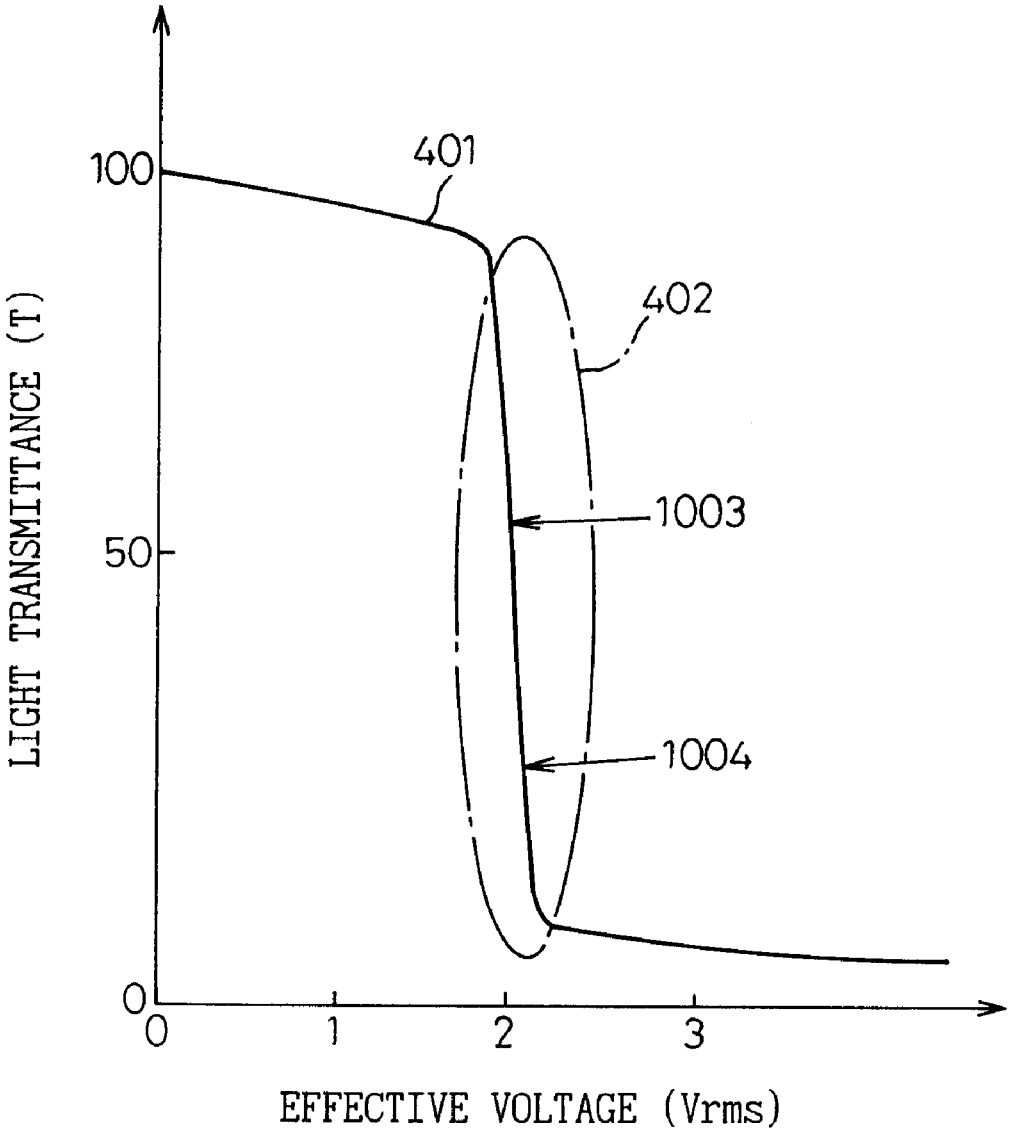
FIG. 10 shows still another curve for explaining the relationship between the effective voltage (Vrms) and the light transmittance (T)

On the other hand, the upper drive waveform 904 is delayed due to the pattern resistance B 802 of the upper electrode for picture-character B 110. The lower waveform 905 is the drive waveform at the lower electrode for picture-character 109. The difference potential 906 indicates a potential difference observed from the lower electrode for picture-character 109. In this case, an effective value, which corresponds to an area shown by slant lines (the delayed portion of the area is reduced), is valid for the liquid crystal. FIG. 10 shows still another curve for explaining the relationship between the effective voltage (Vrms) and the light transmittance (T). The "T-V curve" 401 and the drive extent 402 of the animation area are the same as that of FIG. 7. In this embodiment, 1003 denotes a point for picture-character A. The point 1003 is provided for displaying the picture-character with half tone based on reduction of the effective value due to the delayed waveform of the upper drive waveform 901.

On the other hand, 1004 denotes a point for picture-character B. The point 1004 is provided for displaying the picture-character with half tone based on reduction of the effective value due to the delayed waveform of the upper drive waveform 904.

In this case, the difference between the delayed waveform of the upper waveform 901 and the delayed waveform of the upper waveform 904 is due to the fact that the resistance of the pattern resistance A 801 is larger than that of the pattern resistance B 802. That is, by adjusting the resistance of the pattern electrode, it is possible to display the image with half tone having different density at the upper electrode for picture-character A 111 and the upper electrode for picture-character B 110 in the picture-character area 108. The resistances of the pattern electrode A 112 and the pattern electrode B 113 were explained in the above embodiment. Further, the same means can be applied to the resistance of the lower electrode for picture-character 109.

Figure 11:
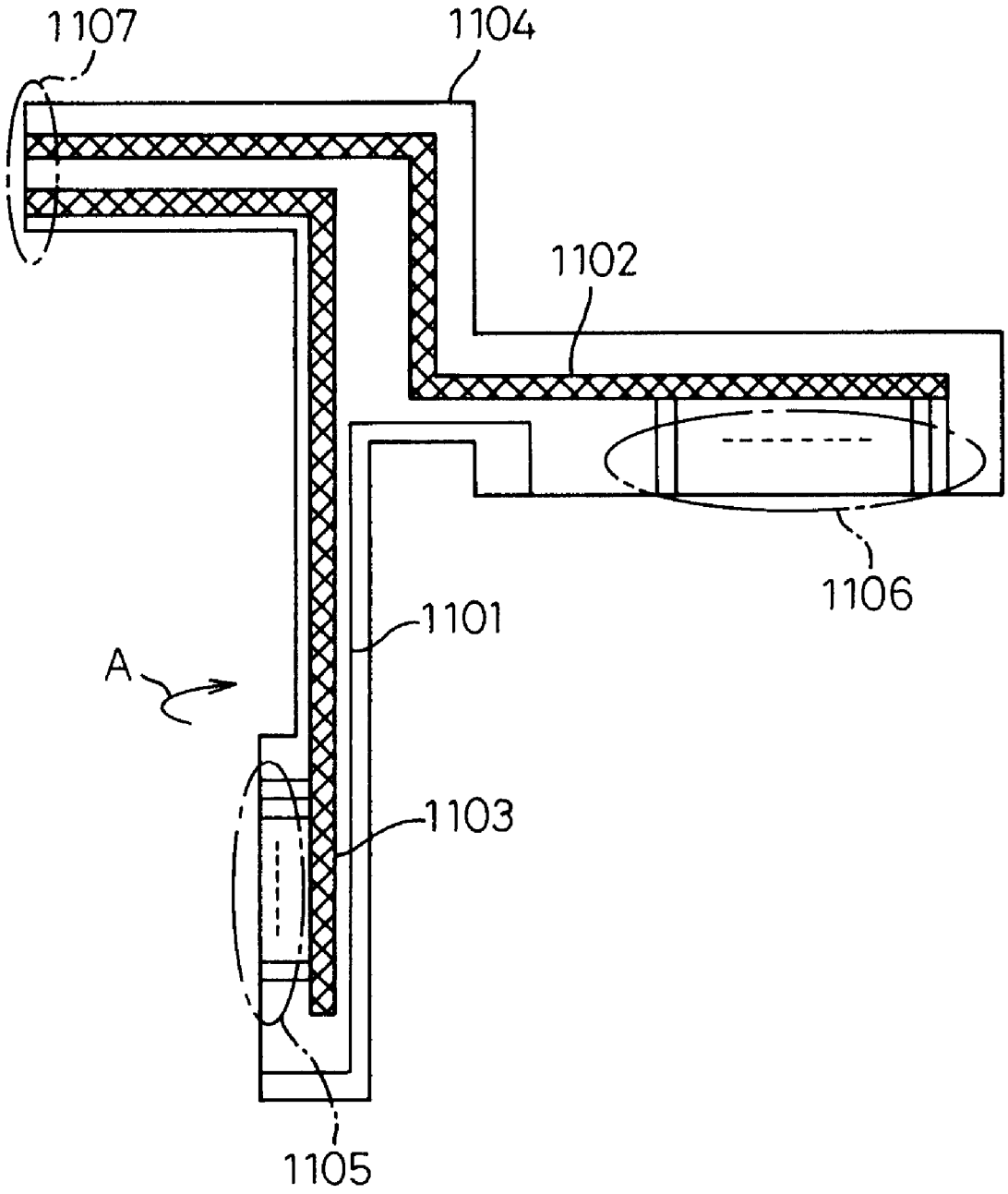
FIG. 11 shows an one-faced wiring FPC according to a fourth embodiment of the present invention.

FIG. 11 shows an one-faced wiring FPC according to a fourth embodiment of the present invention. This one-faced wiring FPC is used for inputting to the data driver 104 and the common driver 103 in FIG. 1, and for connecting to the opposite output terminal 127 and the lower electrode for picture-character 109 in FIG. 1.

In FIG. 11, reference number 1104 is an one-faced wiring FPC according to the fourth embodiment of the present invention. A signal input portion 1107 is used as an area to input signals from an external stage. A data driver input wiring group 1102 is used as the input wiring for driving the data driver 104 in FIG. 1. A common driver input wiring group 1103 is used as the input wiring for driving the common driver 103.

A lower electrode wiring for picture-character 1101 is the electrode for connecting the opposite output terminal 127 and the lower electrode for picture-character 109. This electrode wiring 1101 is arranged to the most left side of a data input portion 1106, and also arranged to the most lower side of a common input portion 1105. When mounting the one-faced wiring FPC 1104, the common input portion 1105 is bent in order to connect to the common driver input wiring group 1103 as shown by an arrow line A.

Figure 12:
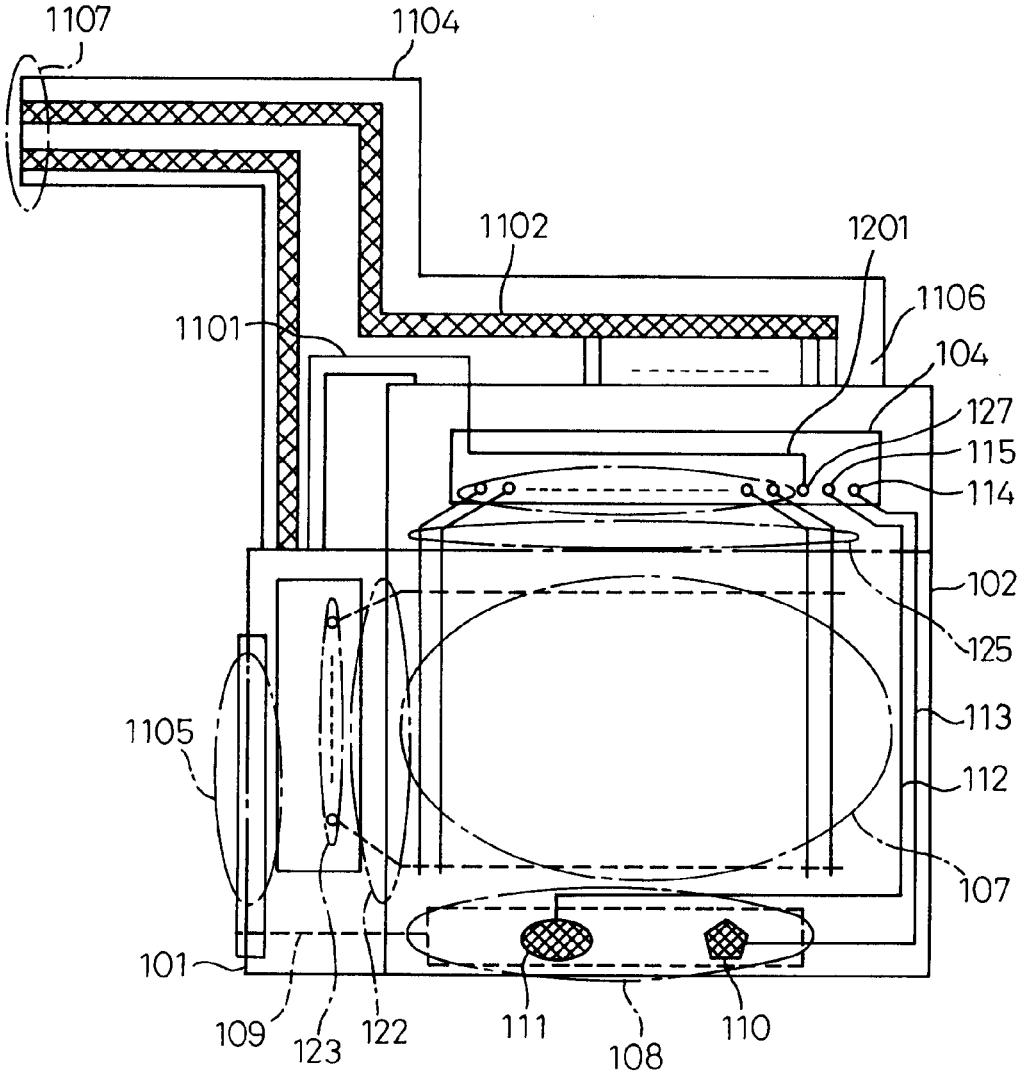
FIG. 12 shows a liquid crystal display apparatus using the one-faced wiring FPC shown in FIG. 11.

FIG. 12 shows a liquid crystal display apparatus using the one-faced wiring FPC 1104 shown in FIG. 11. In FIG. 12, an opposite wiring electrode 1201 is the electrode for connecting the lower electrode wiring for picture-character 1101 to the opposite output terminal 127. In this case, the lower electrode wiring for picture-character 1101 is provided on the one-faced wiring FPC 1104 which is connected to the lower electrode for picture-character 109.

The opposite wiring electrode 1201 is the transparent electrode provided on the column-side IC substrate 102, and provided to the end of the glass of the opposite side passing under the data driver 104. That is, by forming the opposite wiring electrode 1201 to the side of the common driver 103, the opposite output terminal 127 can be connected to the lower electrode for picture-character 109 on the one-faced wiring FPC 1104 in which the data driver input wiring group 1102 and the common driver input wiring group 1103.

In this embodiment, although the opposite output terminal 127 is provided to the opposite side of the common driver 103, it is possible to provide the opposite output terminal 127 to the side of the common driver 103 so that it is possible to easily form the opposite wiring electrode.

According to the above structures shown in the first embodiment to the fourth embodiment, it is possible to easily provide the liquid crystal display apparatus having the animation display area and the picture-character display area with low cost and a simple structure.

What is claimed is:

1. A liquid crystal display apparatus comprising a data circuit for outputting data signals from data signal terminals, a scan circuit for outputting scan signals from scan signal terminals, two substrates, liquid crystal between the two substrates, an animation display area for displaying animation, and a picture-character display area for displaying picture-characters, the animation display area being driven and displayed with time-sharing in accordance with the data signals and the scan signals, wherein each of the data signal terminals is directly connected to one of the two substrates and the scan signal terminals are directly connected to the other of the two substrates, and at least two of the data signal terminals being selected for use in displaying the picture-character, one of the selected data signal terminals connected to a picture-character electrode on one of the two substrates, the other selected data signal terminal connected to a picture-character opposite electrode on the other substrate, the picture-character being displayed in response to data signals on the selected terminals that cause a voltage between the picture-character electrode and the picture-character opposite electrode.

2. A liquid crystal display apparatus as claimed in claim 1, wherein the data signals, which are applied to the picture-character electrode on one of the two substrates and output from one of the selected data signal terminals, are changed to predetermined waveform so that the picture-characters are displayed with half-tones.

3. A liquid display apparatus as claimed in claim 1, wherein the data signals, which are applied to the picture-character electrode on the other substrate and output from the other selected data signal terminal, are changed to predetermined waveform so that the picture-characters are displayed with half-tones.

4. A liquid crystal display apparatus as claimed in claim 1, wherein a predetermined resistance is formed on the picture-character electrode on one of the two substrates so that the picture-characters are displayed with half-tones.

5. A liquid crystal display apparatus as claimed in claim 1, wherein a predetermined resistance is formed on the picture-character opposite electrode on the other substrate so that the picture-characters are displayed with half-tones.

6. A liquid crystal display apparatus as claimed in claim 1, wherein said other selected data signal terminal is connected with said picture-character opposite electrode on the other substrate using a flexible printed-circuit board.

7. A liquid crystal display apparatus comprising a data circuit for outputting data signals from data signal terminals; a scan circuit for outputting scan signals from scan signal terminals; two substrates; liquid crystal between the two substrates; an animation display area for displaying animation, and a picture-character display area for displaying picture-characters, the animation display area being driven and displayed with time-sharing in accordance with the data signals and the scan signals;

wherein at least two terminals of the data signal terminals being selected for use in displaying the picture-character, one of the selected data signal terminals connected to a picture-character electrode on one of the two substrates, the other selected data signal terminal connected to a picture-character opposite electrode on the other substrate, the application of a voltage based upon the data signals between the picture-character electrode and the picture-character opposite electrode causing the picture-character to be displayed.

8. A liquid crystal display apparatus as claimed in claim 7, wherein a half-tone picture-character is displayed by changing at least one of the data signals output to the picture-character electrode on one substrate and the data signals output to the picture-character electrode on the other substrate to a predetermined voltage waveform.

9. A liquid crystal display apparatus comprising a data circuit for outputting data signals, a scan circuit for outputting scan signals, two substrates, liquid crystal between the two substrates; an animation display area for displaying animation; and a picture-character display area for displaying picture-characters; wherein the animation display area is driven and displayed with time-sharing in accordance with the data signals and the scan signals;

at least one picture-character terminal provided on the data circuit; and the picture-character display area being driven and displayed with a static-drive by applying voltage to a picture-character electrode on one substrate and to a picture-character electrode on the other substrate, using the data signals output from the at least one picture-character terminal; and a pattern resistance connected to at least one of the picture-character electrode on one substrate and the picture-character electrode on the other substrate, thereby to change the voltage waveform of the data signals and display half-tone picture-characters.

* * * * *